US006188647B1

(12) United States Patent
Drumheller

(10) Patent No.: US 6,188,647 B1
(45) Date of Patent: Feb. 13, 2001

(54) EXTENSION METHOD OF DRILLSTRING COMPONENT ASSEMBLY

(75) Inventor: Douglas S. Drumheller, Cedar Crest, NM (US)

(73) Assignee: Sandia Corporation, Albuquerque, NM (US)

( * ) Notice: Under 35 U.S.C. 154(b), the term of this patent shall be extended for 0 days.

(21) Appl. No.: 09/306,672

(22) Filed: May 6, 1999

(51) Int. Cl.[7] ..... H04R 17/00; H04R 31/00

(52) U.S. Cl. ..... 367/165; 367/173; 29/25.35; 29/594

(58) Field of Search ..... 367/82, 157, 165, 367/173; 29/594, 25.35

(56) References Cited

U.S. PATENT DOCUMENTS 5,357,486 * 10/1994 Pearce ..... 367/159

5,703,836 12/1997 Drumheller .

* cited by examiner

*Primary Examiner*—Ian J. Lobo
(74) *Attorney, Agent, or Firm*—Russeu D. Elliott

(57) ABSTRACT

A method of assembling transducer tools for down-hole applications wherein piezoelectric elements in the tools are pre-stressed by mechanically stretching an elastic mandrel about which the piezoelectric elements are positioned and subsequently releasing the mandrel so that it contracts causing the piezoelectric elements to be captured in an interference fit in a recess in the mandrel. The method can be adapted to embodiments where the recess in the mandrel is bound by two regions of the mandrel, itself, or where the recess is defined on one end by a portion of the mandrel and on the other end by a separate anvil member positioned against the piezoelectric elements and then secured to the mandrel.

19 Claims, 4 Drawing Sheets

EXTENSION METHOD OF DRILLSTRING COMPONENT ASSEMBLY

This invention was made with Government support under Contract DE-AC04-94AL85000 awarded by the U.S. Department of Energy. The Government has certain rights in the invention.

BACKGROUND OF THE INVENTION

This invention relates to the field of acoustic transducers that use piezoelectric elements installed on a mandrel as acoustic signal generators for use in downhole telemetry applications. More particularly, the invention relates to an improved method of assembling acoustic transducer tools, allowing for easier assembly and in some instances wider machining tolerances in tool components than previously known in conjunction with an earlier version of acoustic transducer patented by the applicant herein.

Background technology underlying recent developments in acoustic telemetry is described in detail in U.S. Pat. No. 5,703,836, which is incorporated herein in its entirety. Also incorporated by reference in its entirety is the patent application Ser. No. 09/307,266 filed in the United States Patent and Trademark Office on the same day as the instant application, and now allowed. Briefly, however, real time or near-real time data acquisition is advantageous in assessing and optimizing performance of subterranean equipment, such as is used in gas and oil wells. Often, in situ use of commonly employed data acquisition instruments is impossible or impractical due to harsh conditions that exist downhole. Communications can be established by way of hardwire connections between downhole and surface elements, however, such connections have proven to be expensive and unreliable under certain conditions. Likewise, attempts to employ traditional radio communications have been largely unsuccessful due to large electromagnetic attenuation.

For these reasons and others, communications systems have been developed that use the drill string elements, themselves, as a wave guide for communications signals. An example of this is the acoustic transducer described in the '836 patent mentioned above. The transducer in that patent comprises a hollow unitary mandrel having a cylindrical recess formed in the outer wall of the mandrel within which recess is captured a stack of piezoelectric elements in a temperature compensated interference fit. The transducer assembly also includes a power source and a protective shell that covers the region of the mandrel and captures the piezoelectric elements. The mandrel can be adapted to connect to production tubing that serves as the waveguide between the transducer downhole and the surface. The transducer is further adapted to receive information from a downhole measurement device such as a pressure/temperature gage.

Acoustic transducer tools, such as the one disclosed in the '836 patent, employ stressed piezoelectric elements. Compression of the piezoelectric elements is desirable to protect the ceramics from tensile failure. In the '836 patent a stack of washer-shaped piezoelectric discs is positioned about a cylindrical recess formed in a hollow mandrel. The discs are securely retained by thermal-expansion compensating rings which are, in turn, secured by the edge of the recess into which the discs and compensating rings are positioned. In the version of the apparatus disclosed in the '836 patent, the necessary compressive stress is obtained as a consequence of the method of assembly described there. Specifically, according to that method, the piezoelectric discs and thermal-expansion compensating rings are provided as pairs of half-cylinders that are emplaced in the cylindrical recess of the mandrel. The positioning of the half-cylinders takes place after the mandrel has been heated to sufficient temperature so as to cause the mandrel (and consequently the cylindrical recess cut into the mandrel) to expand slightly. At that point, the halves of the transducer elements and temperature compensating rings are positioned in the expanded recess, and the mandrel is allowed to cool. As the cooling takes place the mandrel contracts and the piezoelectric elements are captured securely in an interference fit in the mandrel recess.

While it is useful in many instances, the method of assembly just described can, however, prove cumbersome and difficult under certain conditions. Therefore, an unmet need exists for a simpler assembly method.

SUMMARY OF THE INVENTION

The present invention provides a simplified method of acoustic transducer tool assembly characterized by providing a mandrel comprising an elastic material and including two ends and a recess therebetween, the recess being in the form of a modified cylinder symmetric about a central axis. According to the method, force is applied to extend the length of the mandrel and the recess in a dimension substantially parallel to the central axis. Then, piezoelectric elements are positioned in the recess. Finally, the force is released so that the mandrel contracts substantially to its original length and the piezoelectric elements are captured in an interference fit in the recess. In one embodiment described below, the recess is actually formed by two separate elements, including a portion of the mandrel, itself, and an anvil affixed to the mandrel.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

This disclosure pertains to improvements to the acoustic transducer apparatus and its method of assembly described in U.S. Pat. No. 5,703,836. The improvements to be explained also concern an extension method of assembling components that is applicable to various acoustic transducer tool embodiments wherein piezoelectric elements are arranged in an annular fashion about a cylindrical mandrel, and those piezoelectric elements require pre-stressing in order for the tools to function optimally.

In the disclosure associated with the '836 patent the transducer elements are emplaced into a slot in the mandrel as two half cylinders. The half cylinders each comprise two portions, which are present for compensation of thermal expansion, and one sandwich-style PZT ceramic assembly (also provided in two portions). This PZT ceramic assembly serves as the active transducer element. An axial interference fit exists between the half cylinders and the mandrel. This places the mandrel in axial tension while the half cylinders are in axial compression. This pre-stress is critical to the proper operation of the tool. The ceramics must not be put into tension because the PZT is weak in tension.

Figure 1:
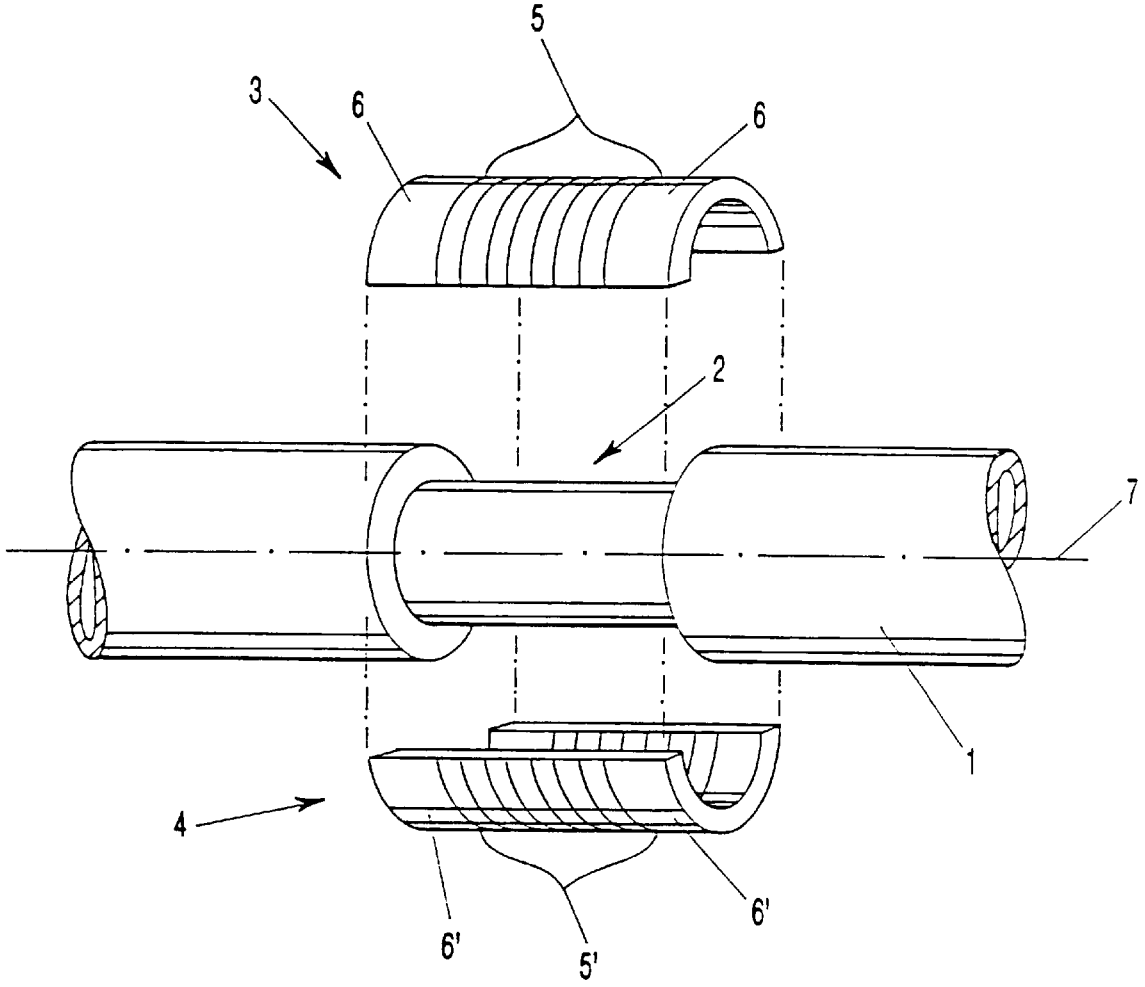
FIG-1 PRIOR ART
FIG. 1 is a partially-exploded side view of a the portion of an acoustic transducer mandrel with transducer elements positioned as described in the '836 patent.

FIG. 1 illustrates an example of the type of assembly just described. A mandrel 1 is provided which includes a cylindrical recess 2. A cylindrical sandwich-style transducer is provided which, when the transducer and the mandrel are at or close to the same temperature, has a length slightly longer than the length of the recess 2. The cylindrical sandwich-style transducer comprises two portions, 3 and 4, each of which forms substantially half of the overall transducer unit. Each half includes stacked piezoelectric elements 5 and 5' which, when assembled, surround the mandrel 1 in the region of the cylindrical recess 2. Each half portion of the sandwich-style transducer likewise includes two thermal expansion rings (expansion compensators) 6 and 6' located on either end of the stack of piezoelectric elements, 5 and 5', respectively. In the embodiment described in the '836 patent, the mandrel 1 is heated so that it expands along its axial dimension 7. As the mandrel 1 expands, the cylindrical recess 2 also enlarges slightly. The two halves 3 and 4 of the transducer are then emplaced opposite each other in the cylindrical recess 2, and the mandrel 1 is allowed to cool. As it cools, the recess 2 contracts with the result that the piezoelectric elements 5 and 5' are compressed and pre-stressed. If in a given case the tolerances are especially tight, in addition to heating (expanding) the mandrel, a charge can be exerted on the PZT elements to cause them to shrink slightly to facilitate assembly.

The function of the tool is to produce stress waves in oilfield tubulars such as drill pipe and production tubing. These stress waves act as carrier waves to transmit information by wireless means in wells that are being drilled or produced, for example. This allows for communication between the surface and below-surface components, such as drill bits and completion equipment. Because of the interference fit, in practice, the lengths of the cylinders and the slot in the mandrel that receives them must be held to close machining tolerances.

The remainder of this disclosure concerns both a modification of the assembly method as well as a new design embodiment that preserves the advantages of the earlier '836 patent design, but allows for wider tolerances. Rather than relying solely on temperature-mediated enlargement (expansion) of the recess into which the piezoelectric elements are positioned, the new method of the present invention involves physical extension of the tool mandrel. The elastic characteristics of the mandrel material supply the force needed to prestress the piezoelectric elements.

As will be described in detail, the assembly method can be adapted to various applications. In one embodiment, a new tool design is described that is easier to assemble than the '836 patent design and allows more precise control of the state of prestress. Even with the older tool embodiment of the '836 patent, however, the assembly method described and claimed herein can be employed beneficially. It is recognized, though, that in the case of that earlier tool embodiment, use of the new assembly method is not likely to have an appreciable effect on necessary machining tolerances.

In the new tool embodiment, the two cylindrical halves of the original transducer elements are replaced by a single complete hollow cylindrical element. This new single element is considerably easier to manufacture than the two half cylinders. The slot in the original mandrel is, in this embodiment, formed by two pieces: the mandrel and a separate hollow cylindrical anvil. Specifically, as described in detail below, a machined portion of the mandrel provides one boundary of the slot and the edge of the anvil provides the other boundary. The anvil is placed onto the mandrel as a thermal interference fit. Using this improved assembly, the ceramics (piezoelectric elements) can be placed in a controlled state of compression.

Figure 2:
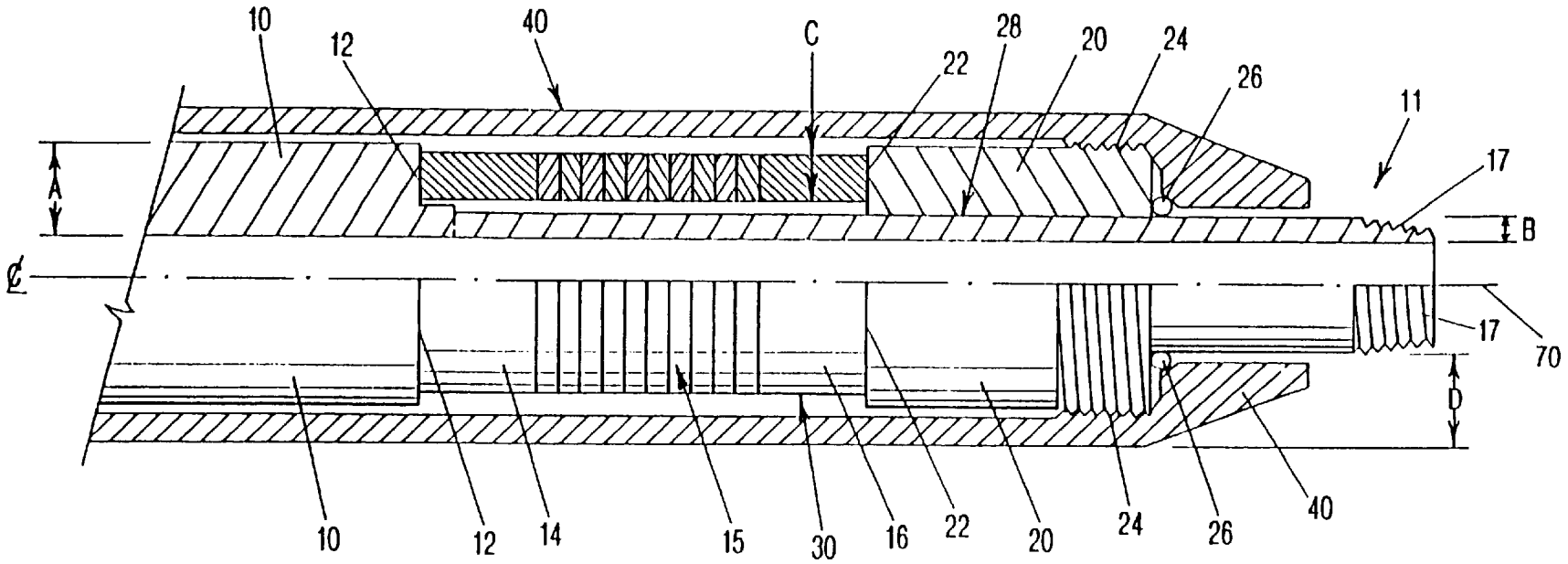
FIG. 2 is a cross section view of a portion of an acoustic transducer mandrel with transducer elements positioned according to a new embodiment different from that described in the '836 patent.

FIG. 2 illustrates a partially cut-away view of the portion of the apparatus of the present invention that includes the ceramic transducer elements. Where cylindrical elements are described, they generally share a single central axis of symmetry 70, as shown, when in their assembled configuration. It is recognized that in practice, some of the elements may not be precisely aligned along the same axis of symmetry. For convenience in this disclosure, however, the single central axis of symmetry 70 is defined and used as a general point of reference. The claims are intended to encompass cases where slight deviations relative to the axis of symmetry are present. The claimed invention is robust in the respect that it can operate within a range of tolerances.

Referring to the figure, a hollow tubular mandrel 10, typically comprised of steel, is provided. (It is recognized that other suitable materials exist and will be apparent to those skilled in the art of drilling operations. Unless otherwise noted, where steel is specified herein, other suitable materials are intended to fall within the description.) The mandrel 10 has been machined or otherwise shaped to include a first region of a given thickness A between the inner and outer surfaces, and a second region of a different given thickness B between the inner and outer surfaces. Thickness A is greater than thickness B, and a surface is described delineating the boundary of the first region. This surface is generally perpendicular to the central axis of symmetry 70 and for purposes of this description will be referred to as the mandrel shoulder 12 which likewise serves as one boundary of a slot (analogous to that described above) into which a sandwich-style transducer is emplaced.

Also shown in the figure is the sandwich-style transducer 30 comprising two cylindrical thermal expansion compensators 14, 16 and a stack of washer-shaped piezoelectric elements 15 positioned between the compensators. Thus, the sandwich-style transducer 30 describes a hollow cylindrical component including both an inner and outer annular surface as well as first and second edges, one on each end of the cylinder. The sandwich-style transducer 30 is positioned over the narrower portion of the mandrel 10 so that its first edge is flush against the mandrel shoulder 12.

The figure also illustrates a hollow cylindrical anvil 20 including, at one of its ends, a threaded region 24 and, at its opposite end, a surface, which is generally perpendicular to the central axis of symmetry 70. For purposes of this description, that surface is referred to as the anvil base 22. The anvil 20 is also positioned over the narrower portion of the mandrel 10 so that the anvil base 22 is flush against the second edge of the sandwich-style transducer 30. (Details about how the anvil is positioned, and how an interference fit is accomplished, are provided later in this disclosure.) In this way, the sandwich-style acoustic transducer 30 is captured between the mandrel shoulder 12 and the anvil base 22.

A cylindrical pressure housing 40 is positioned about the previously described components. It surrounds the entire assembly just described, except that a portion of the narrower part of the mandrel (the second region of the mandrel having thickness B) extends beyond the housing 40 and bears a terminus 11 which, in the preferred embodiment, includes threads 17. Also shown in the figure is an o-ring 26 which is used in the preferred embodiment to form a seal between the housing 40, the anvil 20 and the mandrel 10 in the location shown in the figure where portions of each of those elements are in close proximity. An interference fit 28 exists between the anvil 20 and the mandrel 10 in the final tool thus assembled, and is discussed further below in conjunction with the method of assembly of the tool. Finally, shown in the figure are two additional dimensions that will be of significance when the preferred steps taken in assembling the tool are discussed, below. These are the dimension C representing the distance between the inner and outer diameter of the cylindrical sandwich-style ceramic transducer 30 and the dimension D representing the distance from the outer surface of the narrower portion of the mandrel 10 and the outer perimeter surface of the housing 40. In order to optimize the advantages of the invention, it is important to select parts that minimize the dimension D and simultaneously maximize the dimension C, while still accommodating assembly, operational stresses, and well bore size constraints. Maximizing the dimension C is strongly encouraged since the capability and functionality of the sandwich transducer increases with the size of the ceramic elements stacked together to form the transducer.

Figure 3:
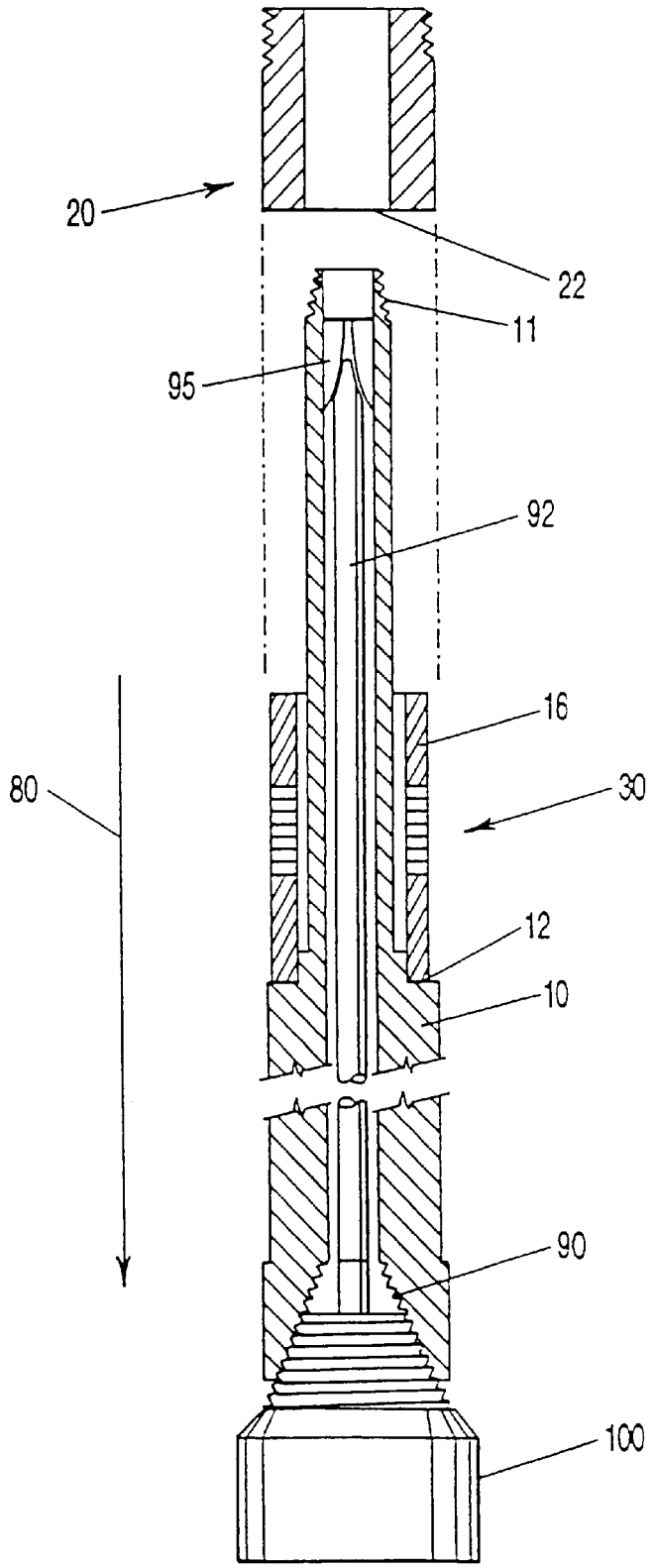
FIG. 3 is a partial cross-sectional view illustrating an extension method of assembling tool components as it is applied to one embodiment of an acoustic transducer tool, together with assembly equipment.

Assembly of the tool just described is accomplished with the aid of a commercial hydraulic jack. This is illustrated in FIG. 3. In the preferred embodiment, the hydraulic jack 100 is connected to the wider end of the mandrel 10 which, as illustrated in the figure, has been modified to include oilfield threads 90 that can be screwed onto the hydraulic jack, as shown. (The use of female oilfield threads in this fashion helps to accomplish the objective, mentioned above, to minimize dimension D.) It is recognized and expected, however, that other methods of securing the mandrel 10 to the jack 100 will be known and used by skilled practitioners in the art, and such other methods are within intended to fall within the scope of the appended claims.

Next, in the preferred embodiment a push rod 92 is placed in the central opening of the hollow cylindrical mandrel 10, and a removable friction-slip assembly 95 is placed on top of the push rod. The friction-slip assembly serves as a barrier against which force can be exerted by the push rod 92. Alternative means for creating such a barrier exist and will be apparent to those skilled in the art practicing the invention. For example, if dimension B allows, threads can be included at the terminus 11 of the mandrel 10, and a cap can be screwed on to create a surface against which the push rod 92 will push, in the operation described below. Likewise, the mandrel can include a welded (or otherwise integral) plug in the region of the terminus 11 of the mandrel. It is also possible for the mandrel to be manufactured from a single drilled-out billet with an undrilled portion in the region of the terminus 11. In both of these latter examples, after stretching is accomplished (as described below), the portion of the terminus 11 including the barrier or plug can be cut off an discarded.

Using this arrangement, the jack 100 is used to temporarily extend the length (stretch) the mandrel 10 by pulling the mandrel in the relative direction shown by the arrow 80 against the resistance provided by the push rod 92. Typically, in the case of a steel mandrel of the type commonly used in oil field applications, approximately 40,000 to 80,000 pounds of load on the jack will stretch the mandrel an appropriate amount without plastically deforming it. Next, the sandwich-style transducer 30 is slid over the narrower part of the mandrel 10 into position against the mandrel shoulder 12. In order to aid in this process, an alignment shoulder can be machined into the mandrel.

Next, the anvil 20 is heated to a temperature sufficient to allow it, due to thermal expansion, to slide into position so that the anvil base 22 lies adjacent to the sandwich-style transducer 30. It may be necessary for care to be taken, using techniques known to those skilled in the art, to cool or otherwise protect the expansion compensator 16, which will contact the anvil base 22. As the anvil 20 cools to ambient temperature it will shrink to an interference fit with the mandrel 10. After sufficient cooling, the hydraulic jack 100, push rod 92 and friction-slip assembly 95 are released and removed. The mandrel 10 returns substantially to its original dimensions, and, in doing so the ceramics in the sandwich-style transducer 30 are subjected to compression. The final level of compression is controlled by the initial stretch imposed by the hydraulic jack as well as the secondary heating of the expansion compensator by contact with the heated anvil.

It is also possible to screw the anvil into place on the mandrel, but this is not the preferred approach since several undesirable effects can occur: First, doing so requires a set of threads on the mandrel that will increase the dimension D and reduce the dimension C, thereby reducing the size and capability of the sandwich transducer. As it is tightened, the anvil will make contact with the sandwich transducer in a rotating fashion. It is commonly known that this can produce undesirable strains in the sandwich elements. The threads will also greatly increase the elastic compliance of the final mandrel-anvil assembly, perhaps by as much as a factor of ten. This decreases the transfer of motion from the sandwich transducer to the mandrel, thereby weakening the stress waves that can be produced.

After the anvil is positioned and the sandwich elements are stressed appropriately, the remaining parts necessary for operation of the tool, including the o-ring seal and external housing pictured in FIG. 2, are assembled prior to deployment of the tool.

Figure 4:
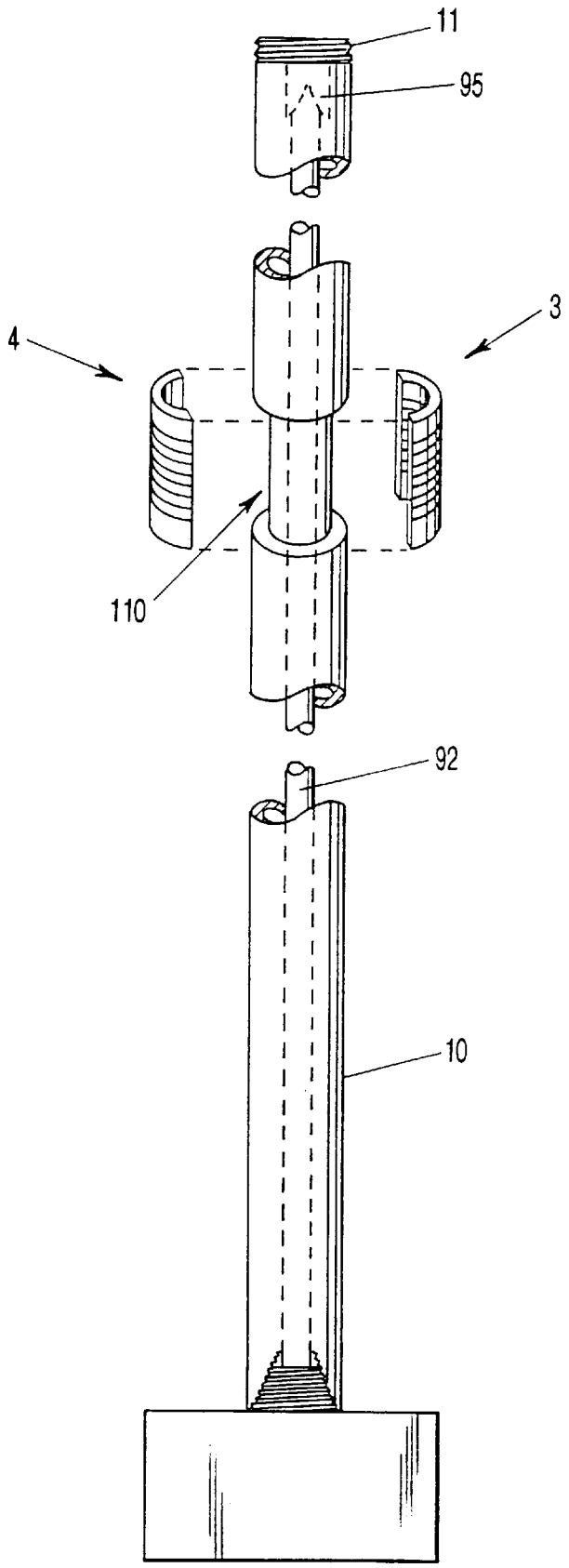
FIG. 4 is a partially exploded, part cross-section view illustrating the extension method of assembling tool components as it is applied to another embodiment of an acoustic transducer tool.

As noted above, the extension (stretching) method can be adapted to various embodiments, provided sufficient tensional force is applied to cause the mandrel to stretch in the region where the transducer elements are located. FIG. 4 contains an illustration of one possible application of this principle in the context of a tool similar to that disclosed in the '836 patent. In the figure, the mandrel 10 is affixed to a hydraulic jack 100 in a fashion similar to that described for FIG. 3. Likewise, a push rod 92 is inserted through the hollow center of the mandrel and into a friction slip assembly 95 or other feature that allows the push rod 92 to exert force against the terminus 11 of the mandrel 10. In this embodiment, instead of using a separate anvil, both sides of a recess 110 are machined from the same piece of metal, as described in the '836 patent. The necessary compressional stress is achieved by using the jack 100 to push the push rod 92 sufficiently to stretch the mandrel 100, including specifically that portion of the mandrel wherein the recess 110 resides, to allow two halves 3 and 4 of a cylindrical sandwich-style transducer assembly to be inserted in the recess 110. Force is then released and the mandrel 100 and recess 110 are restored substantially to their original dimensions, thus creating the desired interference fit capturing the cylindrical sandwich-style transducer and causing the necessary pre-stress condition in the ceremic elements contained therein.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims. The entire disclosures of all references, applications, patents and publications cited above are hereby incorporated by reference.

I claim:

1. A method for assembling an acoustic transducer for use in downhole applications comprising the steps of:

providing a mandrel comprising an elastic material and including two ends and a recess therebetween, the recess being in the form of a modified cylinder substantially symmetric about a central axis, applying force to extend the length of the mandrel and the recess in a dimension substantially parallel to the central axis, positioning piezoelectric elements in the recess, and releasing the force so that the mandrel contracts substantially to its original length and the piezoelectric elements are captured in an interference fit in the recess.

2. The method of claim 1 wherein the elastic material is steel.

3. The method of claim 2 wherein the mandrel comprises a hollow tube comprising a central opening having two ends, the central opening being substantially aligned with the central axis.

4. The method of claim 3 wherein the step of applying force comprises:

securing one end of the mandrel, providing restraint means in physical contact with the mandrel so that force exerted against the restraint means is translated to at least a portion of the mandrel, exerting force against the restraint means in a direction substantially parallel to the central axis and away from the end of the mandrel that is secured.

5. The method of claim 4 wherein the restraint means is selected from the group consisting of a friction slip assembly positioned inside the central opening of the mandrel, a cap affixed to the end of the mandrel opposite the end of the mandrel that is secured, and a plug positioned in the end of the mandrel opposite the end of the mandrel that is secured.

6. The method of claim 5 wherein the exerting force against the restraint means comprises exerting force against a push rod having two ends, the push rod being positioned inside the central opening of the mandrel with one of the push rod ends in physical contact with the restraint means and the other end of the push rod in being in physical contact with a jack means.

7. The method of claim 6 wherein the jack means is a hydraulic jack.

8. A method of assembling an acoustic transducer comprising the steps of:

a) providing a one-piece mandrel in the form of a modified cylinder substantially symmetric about a central axis and having:

two ends, a first mandrel region including an outer surface substantially parallel to the central axis and at a first substantially constant radial distance from the central axis, and a second mandrel region including an outer surface substantially parallel to the central axis and at a second substantially constant radial distance from the central axis, the second substantially constant radial distance being less than the first substantially constant radial distance, whereby the first region includes a shoulder member extending from the outer surface of the first region to the outer surface of the second region, b) positioning over the outer surface of the second region of the mandrel and adjacent to the shoulder member a plurality of washer-shaped discs comprising piezoelectric material and having an outer radius and an inner radius, the inner radius being slightly larger than the substantially constant radial distance associated with the outer surface of the second region of the mandrel, and the outer radius being larger than the inner radius, whereby the second region of the mandrel passes through an aperture defined by the inner radius of the plurality of washer-shaped discs and a portion of the second region of the mandrel extends beyond the plurality of washer-shaped discs, c) applying force to extend the length of the second region of the mandrel dimension substantially parallel to the central axis, d) positioning over the outer surface of the second region of the mandrel extending beyond the plurality of washer-shaped discs an anvil in the form of a cylinder substantially symmetric about the central axis and having:

first and second ends, an outer anvil surface substantially parallel to the central axis and at a third substantially constant radial distance from the central axis, and an anvil central aperture bound by an inner anvil surface that is substantially parallel to the central axis, the inner anvil surface being at a fourth substantially constant radial distance from the central axis, the fourth substantially constant radial distance being less than the third substantially constant radial distance, and a base member in the region of the first end extending from the outer anvil surface to the inner anvil surface, whereby part of the second region of the mandrel extending beyond the plurality of washer-shaped discs passes through the anvil central aperture bound by the inner surface of the anvil, and the base member is adjacent to the plurality of washer-shaped discs, e) securing the anvil to the second region of the mandrel, and f) releasing the force so that the second region of the mandrel contracts substantially to its original length and the plurality of washer-shaped discs are captured between the shoulder member of the first region of the mandrel and the base of the anvil in a pre-stressed interference fit.

9. The method of claim 8 wherein the step of positioning over the outer surface of the second region of the mandrel and adjacent to the shoulder member a plurality of washer-shaped discs and the step of applying force to extend the length of the second region of the mandrel dimension substantially parallel to the central axis are reversed.

10. The method of claim 8 wherein the securing of the anvil to the second region of the mandrel is accomplished by having heated the anvil to expansion prior to its being positioning over the outer surface of the second region of the mandrel extending beyond the plurality of washer-shaped discs and then allowing it to cool thereafter causing an interference fit between the anvil and the second region of the mandrel.

11. The method of claim 9 wherein the securing of the anvil to the second region of the mandrel is accomplished by having heated the anvil to expansion prior to its being positioning over the outer surface of the second region of the mandrel extending beyond the plurality of washer-shaped discs and then allowing it to cool thereafter causing an interference fit between the anvil and the second region of the mandrel.

12. The method of claim 10 wherein the step of applying force comprises:

securing one end of the mandrel, providing restraint means in physical contact with the mandrel so that force exerted against the restraint means is translated to at least a portion of the mandrel, exerting force against the restraint means in a direction substantially parallel to the central axis and away from the end of the mandrel that is secured.

13. The method of claim 11 wherein the step of applying force comprises:

securing one end of the mandrel, providing restraint means in physical contact with the mandrel so that force exerted against the restraint means is translated to at least a portion of the mandrel, exerting force against the restraint means in a direction substantially parallel to the central axis and away from the end of the mandrel that is secured.

14. The method of claim 12 wherein the restraint means is selected from the group consisting of a friction slip assembly positioned inside the central opening of the mandrel, a cap affixed to the end of the mandrel opposite the end of the mandrel that is secured, and a plug positioned in the end of the mandrel opposite the end of the mandrel that is secured.

15. The method of claim 13 wherein the restraint means is selected from the group consisting of a friction slip assembly positioned inside the central opening of the mandrel, a cap affixed to the end of the mandrel opposite the end of the mandrel that is secured, and a plug positioned in the end of the mandrel opposite the end of the mandrel that is secured.

16. The method of claim 14 wherein the exerting force against the restraint means comprises exerting force against a push rod having two ends, the push rod being positioned inside the central opening of the mandrel with one of the push rod ends in physical contact with the restraint means and the other end of the push rod in being in physical contact with a jack means.

17. The method of claim 15 wherein the exerting force against the restraint means comprises exerting pressure against a push rod having two ends, the push rod being positioned inside the central opening of the mandrel with one of the push rod ends in physical contact with the restraint means and the other end of the push rod in being in physical contact with a jack means.

18. The method of claim 16 wherein the jack means is a hydraulic jack.

19. The method of claim 17 wherein the jack means is a hydraulic jack.

* * * * *